US007757923B2

(12) United States Patent
Huang et al.

(10) Patent No.: US 7,757,923 B2
(45) Date of Patent: Jul. 20, 2010

(54) STAPLER WITH A LEG-FLATTING DEVICE

(75) Inventors: Chi-Feng Huang, Chang Hua (TW); I-Hui Liu, Chang Hua (TW); Chun-Hsien Chiang, Chang Hua (TW)

(73) Assignee: SDI Corporation, Chang Hua (TW)

( * ) Notice: Subject to any disclaimer, the term of this patent is extended or adjusted under 35 U.S.C. 154(b) by 108 days.

(21) Appl. No.: 12/219,353

(22) Filed: Jul. 21, 2008

(65) Prior Publication Data

US 2010/0012701 A1 Jan. 21, 2010

(51) Int. Cl.
*B25C 5/11* (2006.01)
*B25C 5/02* (2006.01)

(52) U.S. Cl. ..... 227/132; 227/133; 227/134; 227/135

(58) Field of Classification Search ..... 227/132, 227/133, 134, 135, 19, 15, 17
See application file for complete search history.

(56) References Cited

U.S. PATENT DOCUMENTS 2,801,414 A * 8/1957 Mueller ..... 227/127
4,466,322 A * 8/1984 Mori ..... 83/468
4,887,756 A * 12/1989 Puchy ..... 227/19
5,427,296 A * 6/1995 Chen ..... 227/7
6,286,745 B1 * 9/2001 Ackeret ..... 227/76
6,874,189 B2 * 4/2005 Ackeret ..... 7/160
2007/0057011 A1 * 3/2007 Kandasamy et al. ..... 227/134
2007/0057012 A1 * 3/2007 Kandasamy et al. ..... 227/134
2008/0156164 A1 * 7/2008 Huang ..... 83/687
2008/0308598 A1 * 12/2008 Chang ..... 227/128
2008/0314219 A1 * 12/2008 Liu ..... 83/618
2009/0045240 A1 * 2/2009 Chiang et al. ..... 227/127

* cited by examiner

*Primary Examiner*—Brian D Nash
(74) *Attorney, Agent, or Firm*—Bacon & Thomas, PLLC

(57) ABSTRACT

A stapler has a supporting base, a magazine assembly, a trigger assembly and a leg-flatting device. The trigger assembly has a trigger lever and a pushing element. The pushing element is mounted pivotally on the trigger lever with a pivot and has two pushing arms extending toward the supporting base. The leg-flatting device is mounted on the supporting base and has a sliding base, a moving base and an anvil element. The sliding base is slidably mounted on the supporting base and has a pushed segment corresponding to and selectively pushed by the pushing arms. The moving base is selectively blocked by the sliding base to keep the moving base from moving downwardly before the sliding base sliding relative to the supporting base and has an elongated hole. The anvil element is mounted in the elongated hole in the moving base.

20 Claims, 8 Drawing Sheets

STAPLER WITH A LEG-FLATTING DEVICE

BACKGROUND OF THE INVENTION

1. Field of the Invention

The present invention relates to a stapler, and more particularly to a stapler that has a leg-flatting device to bend legs of a staple flatly.

2. Description of Related Art

A conventional stapler has a leg-bending device to bend legs of a staple. However, the conventional leg-bending device bends legs of staple curved, such that the thickness of documents combined by staples is thick. The bent curved legs cannot hold documents with a large thickness and are easily deformed to injure a person. Therefore, staplers with a leg-flatting device such as Taiwan Patent No. I229026 or I1274637 are provided to solve the aforementioned problems.

The '026 Patent disclosed a leg-flatting device with a V-shaped driving element. The driving element has one end connected pivotally to a front end of a trigger lever to driving the leg-flatting device when the trigger lever is pressed. However, the driving element is connected to the front end of the trigger lever, a large force is needed to operate the stapler. In addition, the structure of the conventional stapler is complicated, the cost for manufacturing the conventional stapler is high. Furthermore, to refill staples into the conventional stapler, the trigger lever shall be pivoted to a large angle to open a staple magazine, but this easily causes the stapler turning over.

The '637 Patent disclosed stapler with a sliding element connected between a trigger lever and a leg-flatting device. When the trigger lever is moved downward, the sliding element will be moved to actuate the leg-flatting device to clinch legs of a release staple. However, the sliding element of the conventional staple has complicated structure, to manufacture and assemble the conventional stapler is trouble and time-consuming. Additionally, the force applied to the trigger lever cannot be efficiently transmitted to the leg-flatting device through the sliding element.

Another conventional stapler disclosed in Taiwan Utility Model No. 299629. The '629 Utility Model disclosed a driving device in a lever system form to connect a trigger lever and provide a labor-saving effect. However, the driving device of the '629 Utility Model also has a complicated structure, and the cost for manufacturing the conventional stapler is also high. In addition, the trigger lever shall be pivoted to a large angle to open a staple magazine for refilling staples, and this easily causes the stapler turning over.

To overcome the shortcomings, the present invention tends to provide a stapler to mitigate or obviate the aforementioned problems.

SUMMARY OF THE INVENTION

The main objective of the invention is to provide a stapler with a labor-saving lever system and a transmission system of the stapler having a single fulcrum to bend legs of staples flatly, simplify structure of the stapler and have a labor-saving capability.

The stapler comprises a supporting base, a magazine assembly, a trigger assembly and a leg-flatting device. The supporting base has a front end and a rear end. The magazine assembly is connected pivotally to the rear end of the supporting base. The trigger assembly is connected pivotally to the rear end of the supporting base at a position above the magazine assembly and has a trigger lever and a pushing element. The trigger lever is connected pivotally to the rear end of the supporting base. The pushing element is mounted pivotally on the trigger lever with a pivot and has two pushing arms extending toward the supporting base. The leg-flatting device is mounted on the supporting base and has a sliding base, a moving base and an anvil element. The sliding base is slidably mounted on the supporting base and has a pushed segment formed on the sliding base and corresponding to and selectively pushed by the pushing arms on the pushing element. The moving base is connected operationally to the supporting base, is selectively blocked by the sliding base to keep the moving base from moving downwardly before the sliding base sliding relative to the supporting base and has a front end and an elongated hole defined in the front end. The anvil element is mounted in the elongated hole in the moving base.

Other objects, advantages and novel features of the invention will become more apparent from the following detailed description when taken in conjunction with the accompanying drawings.

DETAILED DESCRIPTION OF PREFERRED EMBODIMENT

Figure 1:
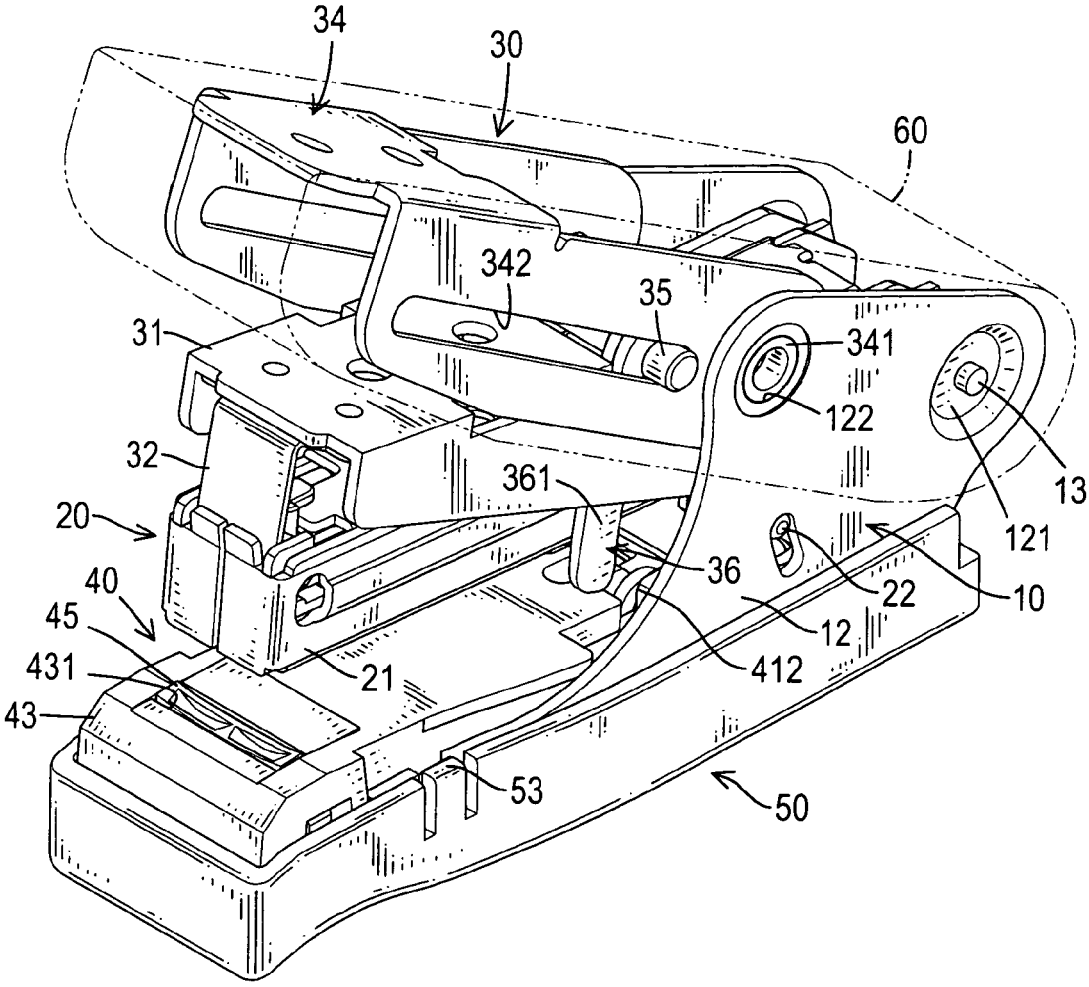
FIG. 1 is a perspective view of a stapler in accordance with the present invention.
Figure 2:
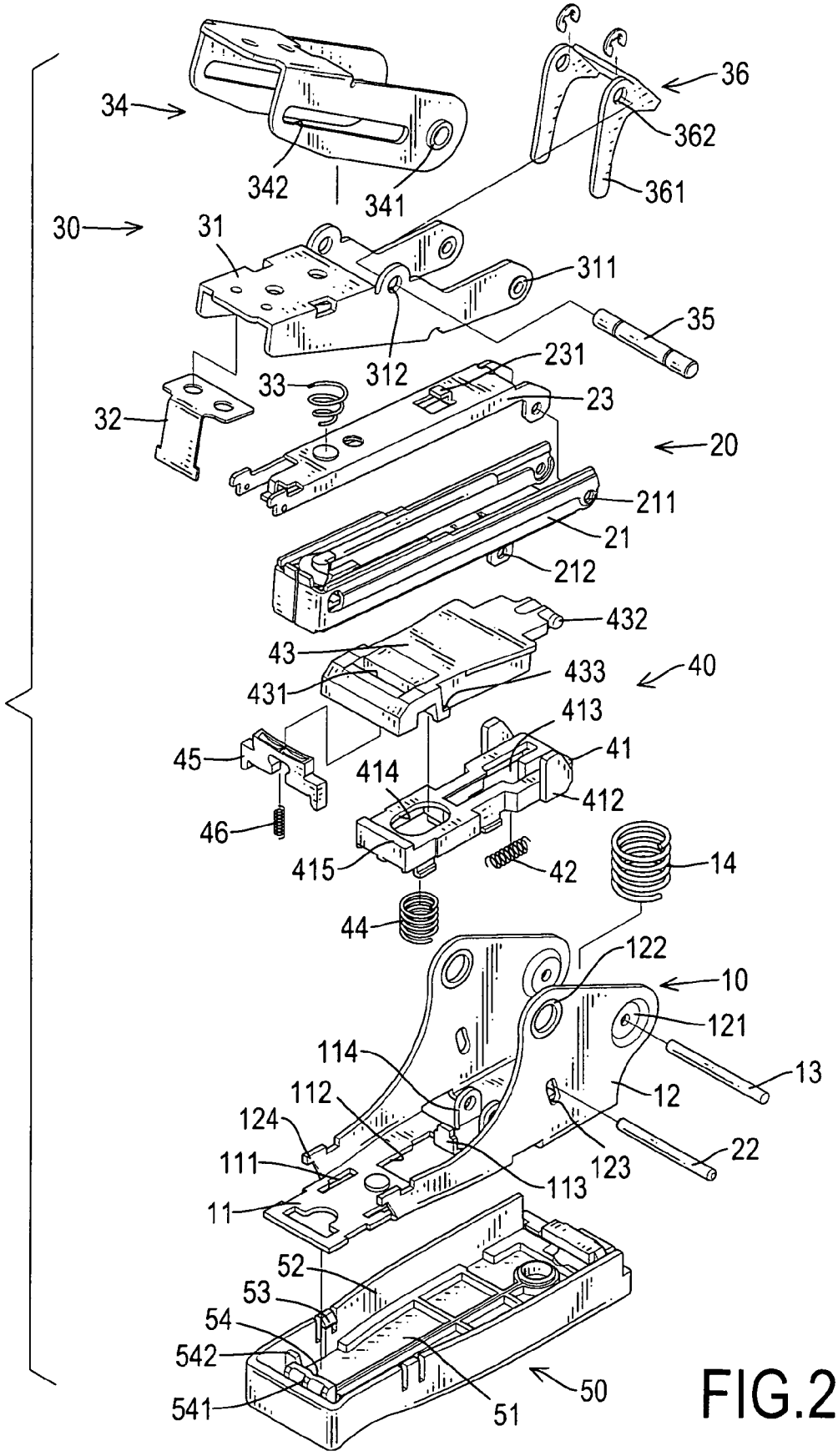
FIG. 2 is an exploded perspective view of the stapler in FIG. 1.

With reference to FIGS. 1 and 2, a stapler in accordance with the present invention comprises a supporting base (10), a magazine assembly (20), a trigger assembly (30), a leg-flatting device (40) and a base holder (50).

The supporting base (10) has a front end, a rear end, a bottom and comprises a bottom board (11) and two side boards (12) formed on and protruding upward from two sides of the bottom board (11). The bottom board (11) is elongated and has a front end, a rear end and a pair of guiding holes (111) and a mounting hole (112). The guiding holes (111) and the mounting hole (112) are defined in the front end of the bottom board (11). Two pivotal tabs (114) are formed on a middle of the bottom board (11) of the supporting base (10). A spring mount (113) is formed on the middle of the bottom board (11) between the mounting hole (112) and the pivotal tabs (114).

Each side board (12) has a main pivoting hole (121) defined at the rear end of the supporting base (10) and aligning with each other and a secondary pivoting hole (122) aligning with each other. A main pivot (13) is mounted through the main pivot holes (121) in the side boards (12) to pivotally connect the magazine assembly (20) and the trigger assembly (30) with the supporting base (10). A curved limiting slot (123) is defined in each side board (12) near the secondary pivoting hole (122) and aligns with each other. Each side board (12) further has a hook (124) formed on a front end of the side board (12).

The magazine assembly (20) is connected pivotally to the rear end of the supporting base (10) with the main pivot (13) and comprises a staple magazine (21), a magazine cap (23) and a limiting rod (22).

The staple magazine (21) is pivotally connected to the rear end of the supporting base (10) with the main pivot (13) and holds staples inside. A magazine spring (14) is mounted between the bottom board (11) of the supporting base (10) and the bottom of the staple magazine (21) to support the staple magazine (21). The staple magazine (21) has a rear end, two pivoting holes (211) and two rod holes (212). The pivoting holes (211) are defined in the rear end of the staple magazine (21), and the main pivot (13) is mounted through the pivoting holes (211) to connect the staple magazine (21) pivotally to the supporting base (10). The rod holes (212) are defined in the middle at the bottom of the staple magazine (21) and correspond to the limiting slots (123) in the side boards (12) of the supporting base (10).

The magazine cap (23) is connected pivotally to the supporting base (10) and the staple magazine (21) with the main pivot (13) and has a top and a hook (231) formed on the top of the magazine cap (23).

The limiting rod (22) is mounted through the rod holes (212) in the staple magazine (21) and has two ends respectively held slidably in the limiting slots (123) in the supporting base (10).

Figure 3:
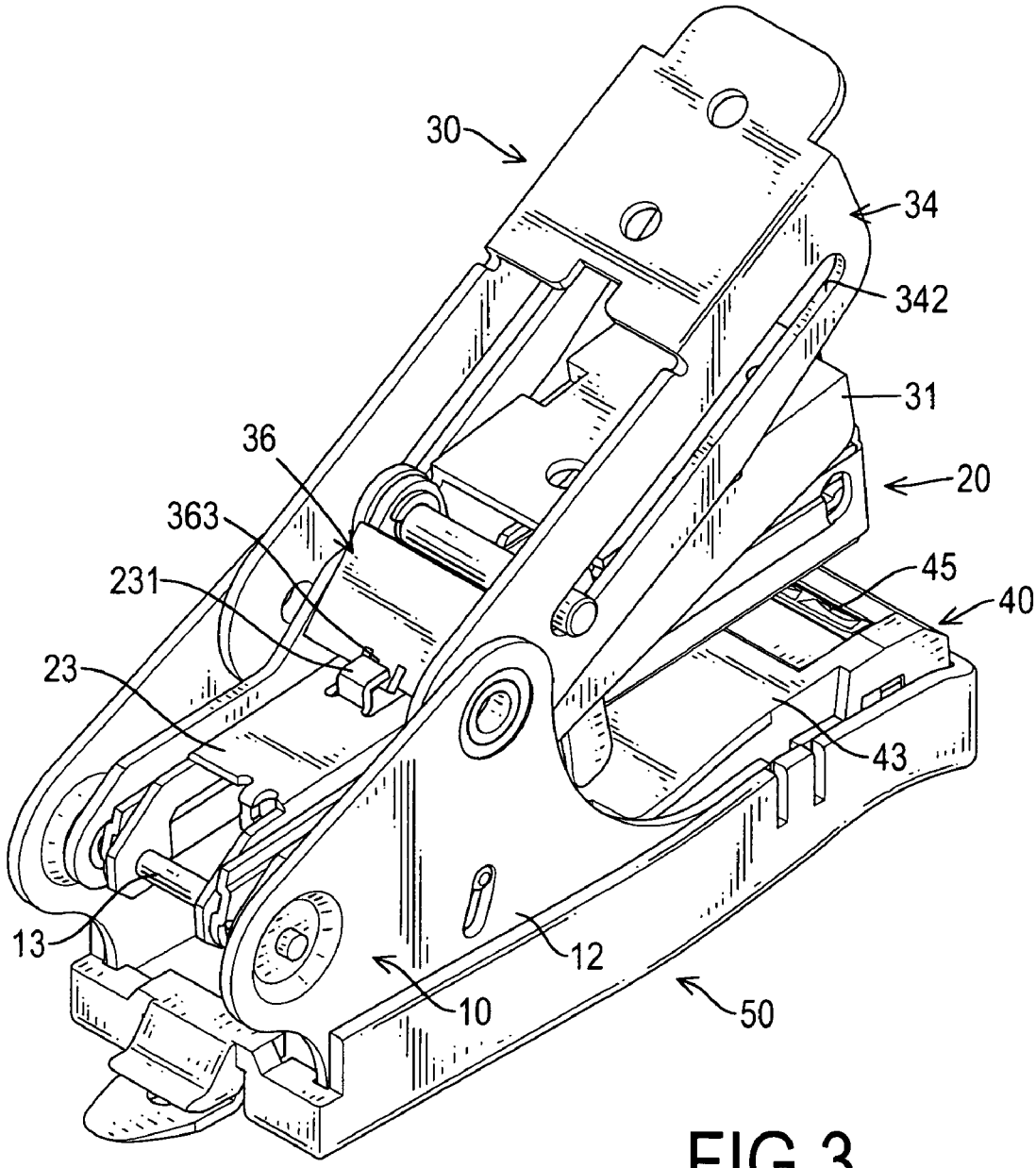
FIG. 3 is a rear perspective view of the stapler in FIG. 1.

With further reference to FIG. 3, the trigger assembly (30) is connected pivotally to the rear end of the supporting base (10) with the main pivot (13) at a position above the magazine assembly (20) and comprises a trigger lever (31), a pushing element (36), a pivot (35) and an auxiliary lever (34).

The trigger lever (31) is connected pivotally to the rear end of the supporting base (10) with the main pivot (13). The trigger lever (31) has a front end, a rear end, a middle, two pivoting holes (311) and two pivotal holes (312). The pivoting holes (311) are defined in the rear end of the trigger lever (31) and align with each other. The main pivot (13) is mounted through the pivoting holes (311) to connect the trigger lever (31) pivotally with the supporting base (10). The pivotal holes (312) are defined in the top at the middle of the trigger lever (31) and align with each other. The staple driving tab (32) is attached securely to the front end of the trigger lever (31) and engages slidably the magazine cap (23). A trigger spring (33) is mounted between and abuts with the trigger lever (31) and the magazine cap (23).

The pushing element (36) is U-shaped, is mounted pivotally on the trigger lever (31) with the pivot (35) and has a top board and two pushing arms (361). The top board has two ends and an engaging tap (363) engaging the hook (231) on the magazine cap (23). The pushing arms (361) are curved and extend respectively from the ends of the top board and toward the supporting base (10). Each pushing arm (361) has a pivotal hole (362) aligning with each other.

The pivot (35) is mounted through the pivotal holes (312, 362) in the trigger lever (31) and the pushing arms (361) to pivotally connect the pushing element (36) to the trigger lever (31). The pivot (35) of the trigger assembly (30) and the pushing arms (361) of the pushing element (36) are arranged along a pivotal route at a center of the main pivot (13).

The auxiliary lever (34) is pivotally connected to the rear end of the supporting base (10) and has two side boards formed on and extending downward from a top of the auxiliary lever (34). Each side board of the auxiliary lever (34) has a pivotal stub (341) formed on a rear end of the side board and rotatably mounted in the secondary pivoting hole (122) in a corresponding one of the side boards (12) of the supporting base (10) to pivotally connect the auxiliary lever (34) to the supporting base (10).

The auxiliary lever (34) has a rail on which the pivot (35) of the trigger assembly (30) is slidably mounted. The rail of the auxiliary lever (34) comprises two slots (342) defined respectively through the side boards of the auxiliary lever (34). Two ends of the pivot (35) of the trigger assembly (30) are respectively held slidably in the slots (342) in the side boards of the auxiliary lever (34).

Figure 5:
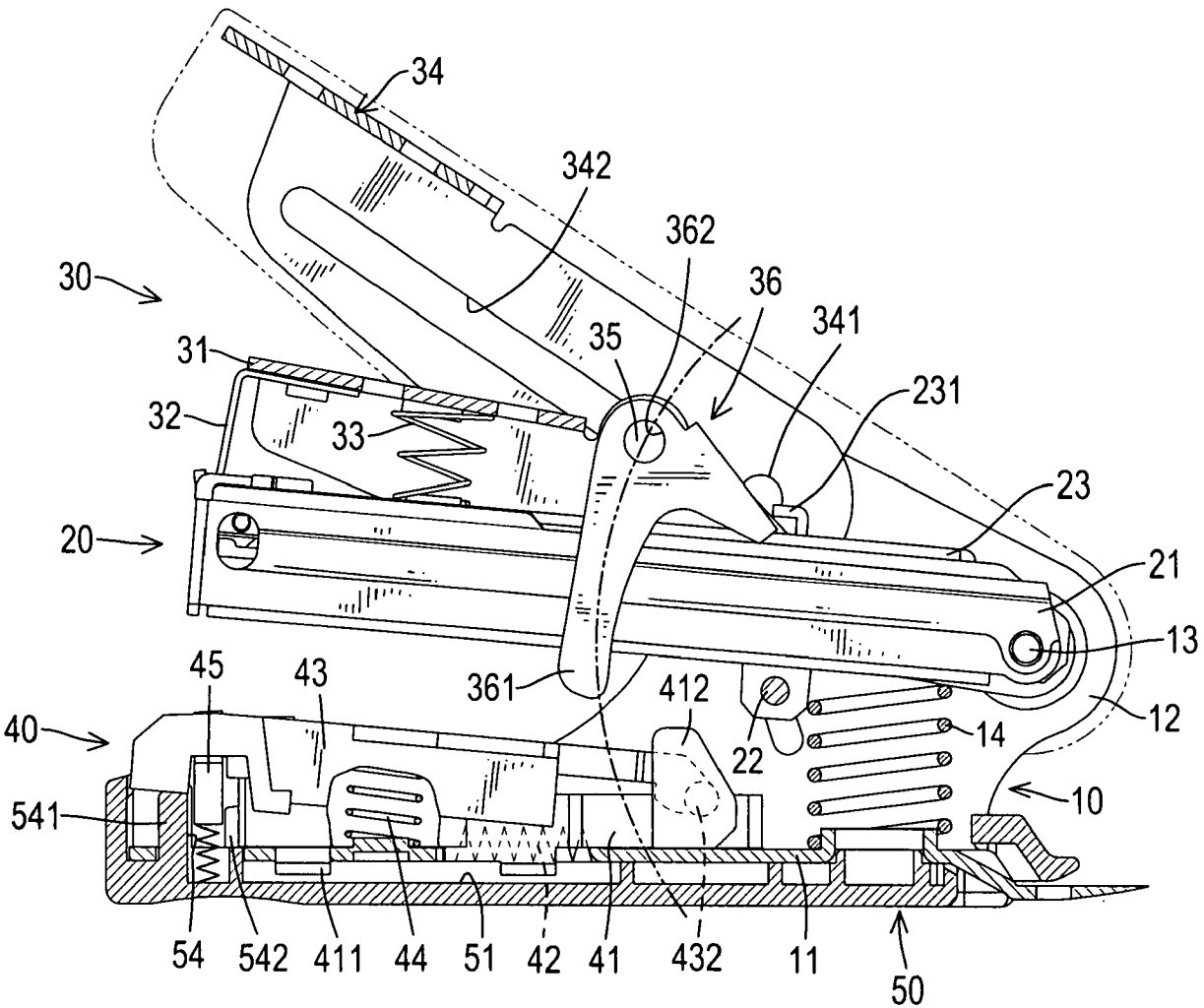
FIG. 5 is a side view in partial section of the stapler in FIG. 1.
Figure 6:
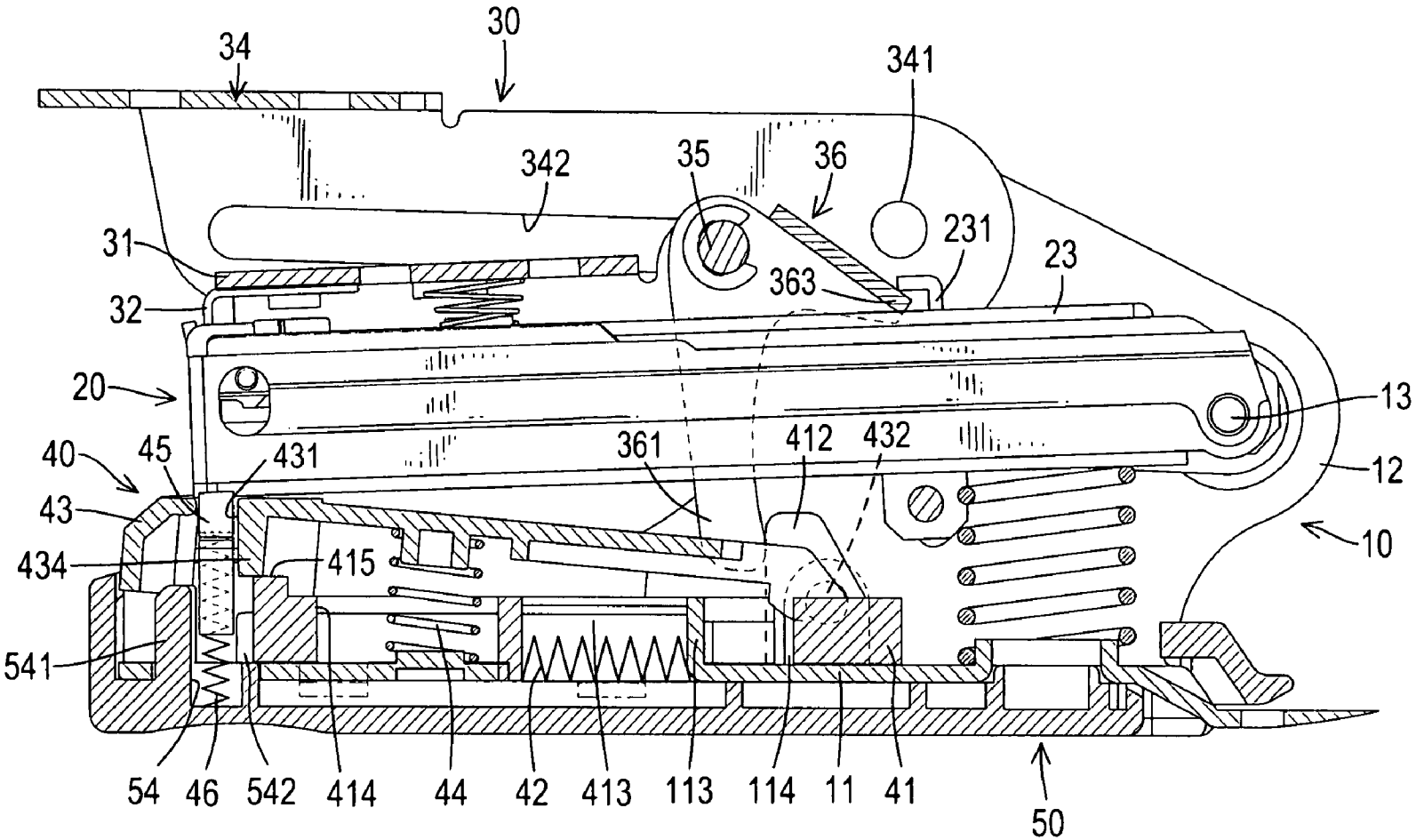
FIG. 6 is an operational side view in partial section of the stapler in FIG. 1 showing the trigger assembly being pressed.

With reference to FIGS. 2, 5 and 6, the leg-flatting device (40) is mounted on the supporting base (10) and comprises a sliding base (41), a moving base (43) and an anvil element (45).

The sliding base (41) is slidably mounted on the supporting base (10) and has a pushed segment formed on the sliding base (41) and corresponding to and selectively pushed by the pushing arms (361) on the pushing element (36). The pushed segment of the sliding base (41) is arranged along the pivotal route along which the pivot (35) of the trigger assembly (30) and the pushing arms (361) of the pushing element (36) are arranged. In a preferred embodiment, the pushed segment comprises two pushed tabs (412) mounted on two sides at the rear end of the sliding base (41).

The sliding base (41) further has multiple engaging tabs (411) formed on and protruding from a bottom of the sliding base (41) and respectively engaging slidably the guiding holes (111) and the mounting hole (112) in the bottom board (11) of the supporting base (10).

The sliding base (41) further has an abutting rib (415) formed on a front end of the sliding base (41) and an opening (414) defined through the sliding base (41) near the front end.

A retracting spring (42) is mounted between the spring mount (113) on the supporting base and the sliding base (41) to provide recoil force to the sliding base. In a preferred embodiment, the sliding base (41) has a spring channel (413) defined in a middle of the sliding base (41) to hold the retracting spring (42) inside.

The moving base (43) is connected operationally, preferably pivotally to the supporting base (10) and is selectively blocked by the sliding base (41) to keep the moving base (43) from moving downwardly before the sliding base (41) is pushed by the pushing arms (361) to slide relative to the supporting base (10). The moving base (43) has a front end, a rear end and an elongated hole (431) defined in the front end. Two pivotal stubs (432) are formed on the rear end of the moving base (43) and are rotatably connected with the pivotal tabs (114) on the supporting base (10) to pivotally connect the moving base (43) to the supporting base (10).

The moving base (43) further has an abutting flange (434) formed on a bottom at the front end of the moving base (43) and abutting with the abutting rib (415) on the sliding base (41).

In addition, a base spring (44) is held in the opening (414) in the sliding base (41) and is mounted between the moving base (43) and the bottom board of the supporting base (10) to support and provide a recoil force to the moving base (43).

The anvil element (45) is mounted in the elongated hole (431) in the moving base (43), is supported by a supporting spring (46) and corresponds to the staple driving tab (32).

With reference to FIGS. 1 and 2, the base holder (50) is mounted on the bottom of the supporting base (10) and has a front end, a recess (51), two side walls (52), two hooking arms (53) and a sliding channel (54).

The recess (51) is defined in a top of the base holder (50) to hole the bottom board (11) of the supporting base (10) inside and defines the side walls (52) respectively at two sides of the base holder (50). The hooking arms (53) are formed respectively on the side walls (52) and engage respectively the front ends of the side boards (12) of the supporting base (10) to securely hold the supporting base (10) on the base holder (50).

The sliding channel (54) is defined in the front end of the base holder (50) to movably hold the anvil element (45) in the sliding channel (54). In a preferred embodiment, the sliding channel (54) is defined between a front tab (541) and two side tabs (542) formed near the side walls (52).

Figure 4:
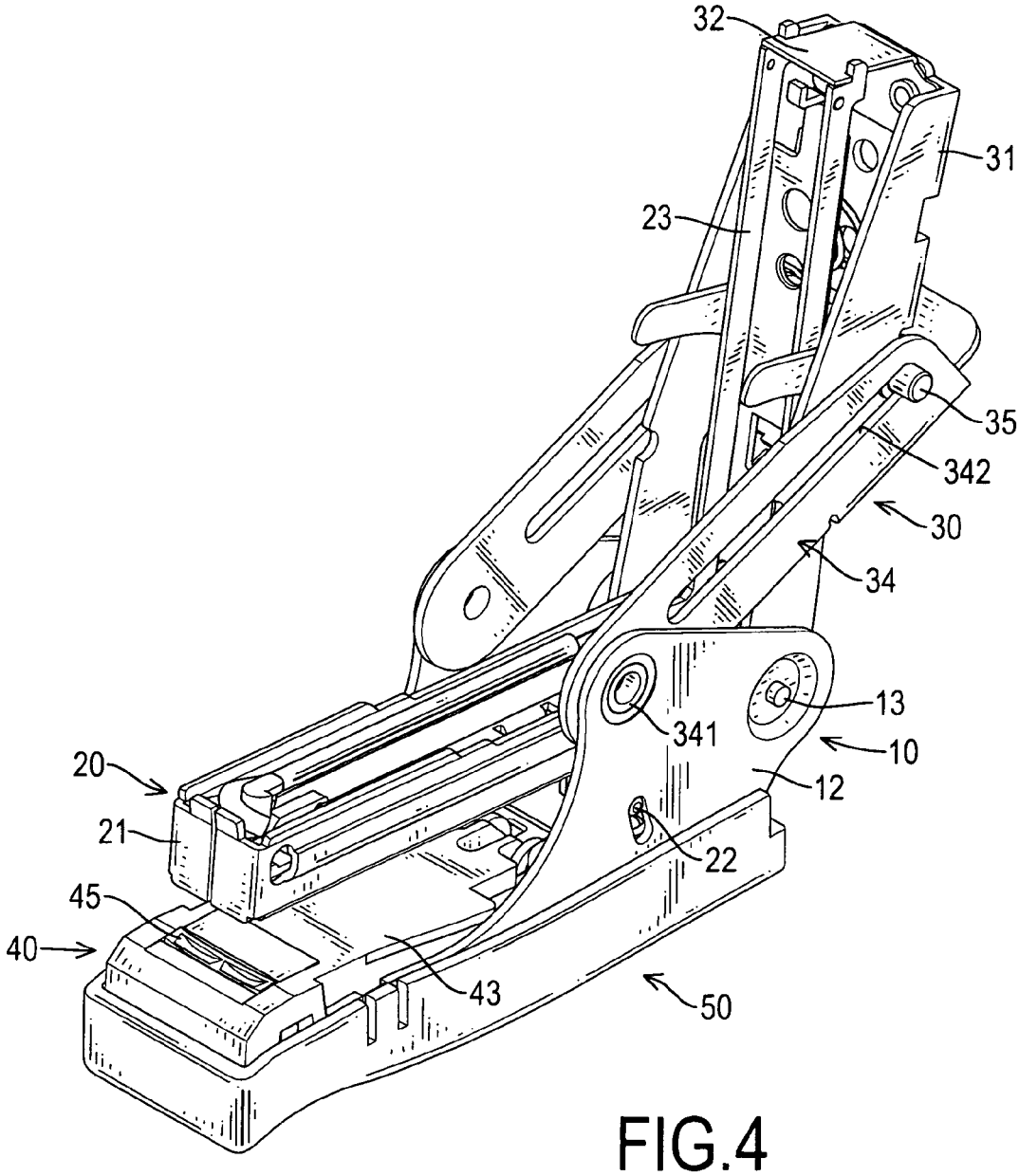
FIG. 4 is a perspective view of the stapler in FIG. 1 showing the stapler being opened for refilling staples.

With reference to FIGS. 1 and 4, to fill staples, the trigger assembly (30) is pulled upward, the trigger lever (31) is pivoted relative to the supporting base (10) and the pivot (35) slides along the rail on the auxiliary lever (34). Consequently, the magazine cap (23) is pivoted with the trigger lever (31) relative to the supporting base (10), and the staple magazine (21) is opened for filling staples. Accordingly, to refill staples into the stapler is convenient and easy. In addition, with a limiting effect provided by the rail on the auxiliary lever (34) to the pivot (35), the trigger lever (31) only can be pivoted to a position where the trigger lever (31) is substantially perpendicular to the supporting base (10). Therefore, the gravity center of the stapler can be always held in the area of the supporting base (10), the stapler can be kept stable on a plane even when the trigger assembly (30) is pivoted to a refilling position.

Figure 8:
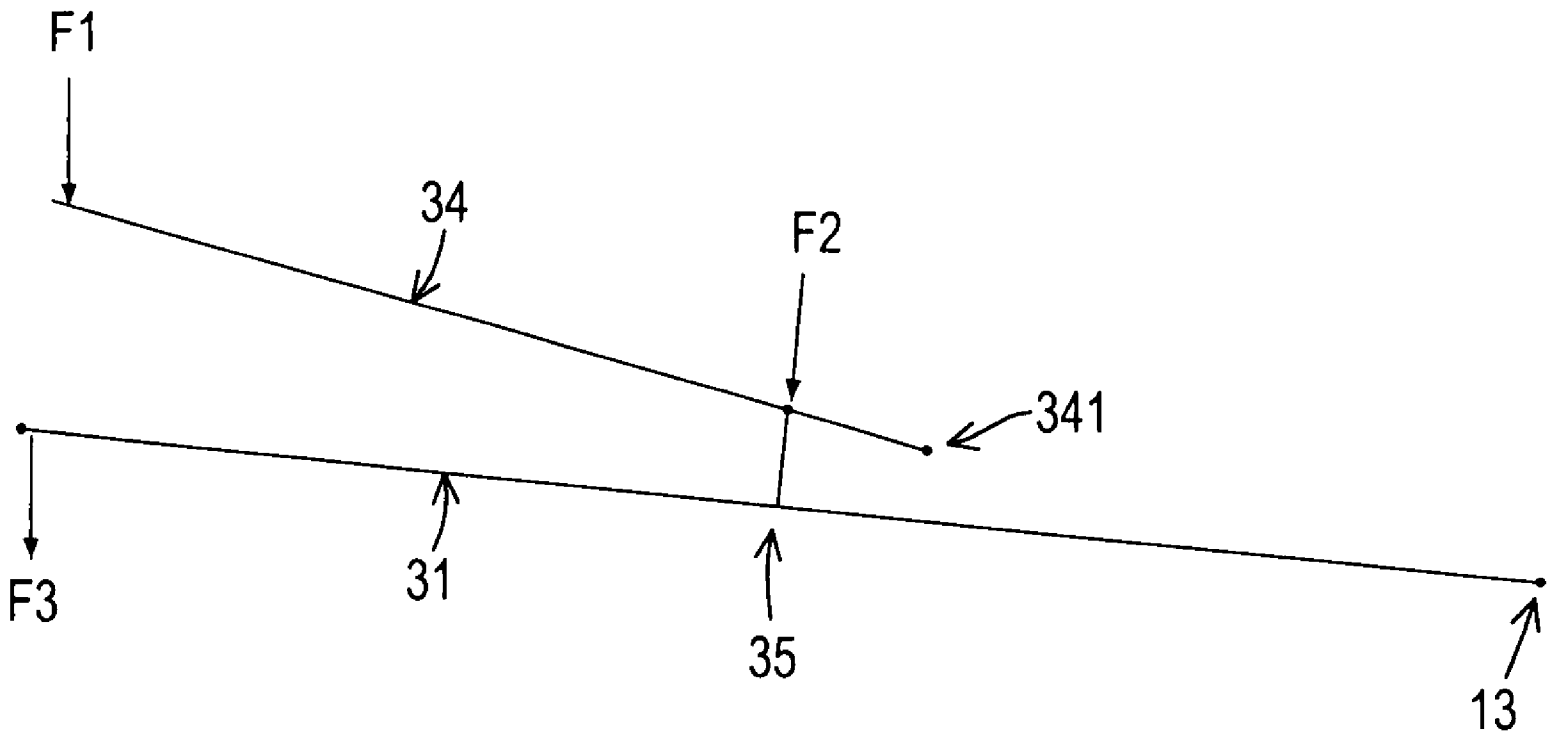
FIG. 8 is a side view of the stapler in FIG. 6 with force lines indicated.

With reference to FIGS. 1, 5 and 8, when the trigger assembly (30) is pressed, the auxiliary lever (34) is moved downward to make trigger lever (31) being pivoted downward at a center of the main pivot (13). The driving tab (32) is moved downward to press against one of the staples to be released from in the staple magazine (21). With the anvil element (45), the legs of the released staple can be clinched.

Equations as follows are used to prove that the stapler is laborsaving and is convenient to use. The equations include an input force (F1) at the front end of the auxiliary lever (34), an internal force (F2) applied at the pivot (35), an output force (F3) applied at the front end of the trigger lever (31). A ratio of a length of the auxiliary lever (34) and a distance from the pivot (35) to the pivotal stubs (341) is 5. A ratio of the length of the trigger lever (31) and a distance from the pivot (35) to the main pivot (14) is 2.

$$F1\times5=F2\times1;$$

$$F1/F2=1/5;\ F1=0.2F2;$$

$$F2\times1=F3\times2;\ F3=0.5F2;$$

$$F3/F1=0.5F2/0.2F2=2.5;$$

$$F3=2.5F1$$

Because the output force (F3) is 2.5 times the input force (F1), the stapler is laborsaving.

Figure 7:
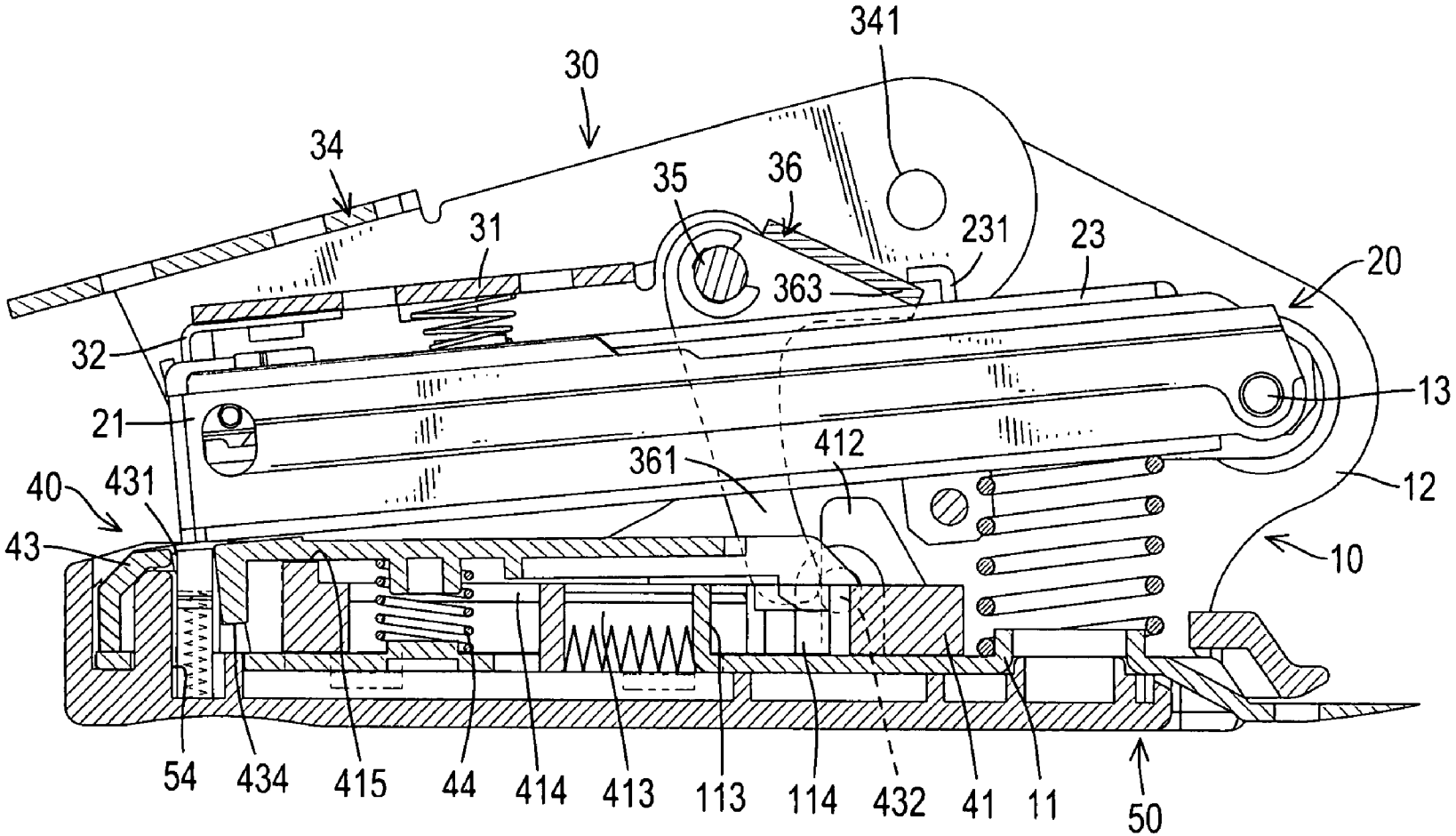
FIG. 7 is an operational side view in partial section of the stapler in FIG. 1 showing the sliding base of the leg-flatting device being slid by the pushing element.

With reference to FIGS. 5 to 7, when the trigger lever (31) is moved downward, the pushing element (36) will move downward with the trigger lever (31) and push against the pushed segment on the sliding base (41). Consequently, the sliding base (41) will be pushed to move toward the rear end of the supporting base (10) to release the blocking effect to the moving base (43). Thus, the moving base (43) with the anvil element (45) will move downward to clinch the legs of a released staple.

Because the pushing element (36) is mounted pivotally on a middle of the trigger lever (31), the leg-flatting device (40) is pushed directly by the pushing element (36). Thus, the structure of the stapler can be simplified and the operation of the stapler can be precisely controlled. Additionally, the trigger assembly (30) is designed to have a labor-saving capability as a lever device, the labor-saving lever system and the transmission system of the stapler in accordance with the present invention has a single fulcrum. The actions of the elements of the trigger assembly (30) in different operating times can be efficiently transferred to the leg-flatting device (40) via the pushing element (36). Accordingly, the operation time of the trigger assembly (30) is short, so the stapler is labor-saving and the structure of the stapler is simplified.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stapler comprising:

a supporting base having a front end; and a rear end;

a magazine assembly connected pivotally to the rear end of the supporting base;

a trigger assembly connected pivotally to the rear end of the supporting base at a position above the magazine assembly and having a trigger lever connected pivotally to the rear end of the supporting base; and a pushing element mounted pivotally on the trigger lever with a pivot and having two pushing arms extending toward the supporting base;

a leg-flatting device mounted on the supporting base and having a sliding base slidably mounted on the supporting base and having a pushed segment corresponding to and selectively pushed by the pushing arms;

a moving base connected operationally to the supporting base, selectively blocked by the sliding base to keep the moving base from moving downwardly before the sliding base is pushed by the pushing arms to slide relative to the supporting base, the moving base having a front end; and an elongated hole defined in the front end of the moving base; and an anvil element mounted in the elongated hole in the moving base.

2. The stapler as claimed in claim 1, wherein the supporting base has a main pivot mounted on the rear end of the supporting base;

the magazine assembly and trigger lever are pivotally connected to the supporting base with the main pivot; and the pivot of the trigger assembly, the pushing arms of the pushing element and the pushed segment of the sliding base are arranged along a pivotal route at a center of the main pivot.

3. The stapler as claimed in claim 2, wherein the pushing element has a top board with two ends;

the pushing arms are curved, extend respectively from the ends of the top board and each has a pivotal hole aligning with each other; and the pivot of the trigger assembly is mounted through the pivotal holes in the pushing arms to pivotally connect the pushing element to the trigger lever.

4. The stapler as claimed in claim 3, wherein the magazine assembly comprises a magazine cap having a top and a hook formed on the top of the magazine cap; and the top board of the pushing element has an engaging tap engaging the hook on the magazine cap.

5. The stapler as claimed in claim 4, wherein the trigger lever has a staple driving tab attached to a front end of the trigger lever and engaging slidably the magazine cap; and a trigger spring is mounted between and abuts with the trigger lever and the magazine cap.

6. The stapler as claimed in claim 5, wherein the trigger assembly further comprises an auxiliary lever pivotally connected to the rear end of the supporting base and having a rail on which the pivot of the trigger assembly is slidably mounted.

7. The stapler as claimed in claim 6, wherein the auxiliary lever has two side boards formed on and extending downward from a top of the auxiliary lever;

the rail of the auxiliary lever comprises two slots defined respectively through the side boards; and two ends of the pivot of the trigger assembly are respectively held slidably in the slots in the side boards of the auxiliary lever.

8. The stapler as claimed in claim 7, wherein the trigger lever has two pivotal holes defined in a top of the trigger lever and aligning with each other; and the pivot of the trigger assembly is mounted through the pivotal holes in the trigger lever.

9. The stapler as claimed in claim 8, wherein the supporting base comprises an elongated bottom board having a front end, a rear end, a pair of guiding holes defined in the front end of the bottom board and a mounting hole defined in the front end of the bottom board;

the sliding base has multiple engaging tabs formed on and protruding from a bottom of the sliding base and respectively engaging slidably the guiding holes and the mounting hole in the bottom board of the supporting base.

10. The stapler as claimed in claim 9, wherein the supporting base has two pivotal tabs formed on the bottom board of the supporting base; and the moving base has two pivotal stubs formed on a rear end of the moving base and rotatably connected with the pivotal tabs on the supporting base to pivotally connect the moving base to the supporting base.

11. The stapler as claimed in claim 10, wherein the sliding base has an abutting rib formed on a front end of the sliding base; and the moving base has an abutting flange formed on a bottom at the front end of the moving base and abutting with the abutting rib on the sliding base.

12. The stapler as claimed in claim 11 further comprising a base holder mounted on a bottom of the supporting base and having a front end and a sliding channel defined in the front end of the base holder; and the anvil element is movably mounted in the sliding channel in the base holder.

13. The stapler as claimed in claim 1, wherein the pushing element has a top board with two ends;

the pushing arms are curved, extend respectively from the ends of the top board and each has a pivotal hole aligning with each other; and the pivot of the trigger assembly is mounted through the pivotal holes in the pushing arms to pivotally connect the pushing element to the trigger lever.

14. The stapler as claimed in claim 1, wherein the magazine assembly comprises a magazine cap having a top and a hook formed on the top of the magazine cap; and the top board of the pushing element has an engaging tap engaging the hook on the magazine cap.

15. The stapler as claimed in claim 1, wherein the trigger lever has a staple driving tab attached to a front end of the trigger lever and engaging slidably the magazine cap; and a trigger spring is mounted between and abuts with the trigger lever and the magazine cap.

16. The stapler as claimed in claim 1, wherein the trigger assembly further comprises an auxiliary lever pivotally connected to the rear end of the supporting base and having a rail on which the pivot of the trigger assembly is slidably mounted.

17. The stapler as claimed in claim 16, wherein the auxiliary lever has two side boards formed on and extending downward from a top of the auxiliary lever;

the rail of the auxiliary lever comprises two slots defined respectively through the side boards; and two ends of the pivot of the trigger assembly are respectively held slidably in the slots in the side boards of the auxiliary lever.

18. The stapler as claimed in claim 1, wherein the trigger lever has two pivotal holes defined in a top of the trigger lever and aligning with each other; and the pivot of the trigger assembly is mounted through the pivotal holes in the trigger lever.

19. The stapler as claimed in claim 1, wherein the supporting base comprises an elongated bottom board having a front end, a rear end, a pair of guiding holes defined in the front end of the bottom board and a mounting hole defined in the front end of the bottom board;

the supporting base has two pivotal tabs formed on the bottom board of the supporting base;

the sliding base has multiple engaging tabs formed on and protruding from a bottom of the sliding base and respectively engaging slidably the guiding holes and the mounting hole in the bottom board of the supporting base; and the moving base has two pivotal stubs formed on a rear end of the moving base and rotatably connected with the pivotal tabs on the supporting base to pivotally connect the moving base to the supporting base.

20. The stapler as claimed in claim 1 further comprising a base holder mounted on a bottom of the supporting base and having a front end and a sliding channel defined in the front end of the base holder; and the anvil element is movably mounted in the sliding channel in the base holder.

* * * * *